US009943163B1

(12) United States Patent
Newbury

(10) Patent No.: US 9,943,163 B1
(45) Date of Patent: Apr. 17, 2018

(54) TOOTHBRUSH

(71) Applicant: John Charles Newbury, Neath (GB)

(72) Inventor: John Charles Newbury, Neath (GB)

( * ) Notice: Subject to any disclaimer, the term of this patent is extended or adjusted under 35 U.S.C. 154(b) by 0 days.

(21) Appl. No.: 14/544,876

(22) Filed: Mar. 2, 2015

(51) Int. Cl.
*A46B 9/04* (2006.01)

(52) U.S. Cl.
CPC ..... *A46B 9/04* (2013.01); *A46B 2200/1066* (2013.01)

(58) Field of Classification Search
None
See application file for complete search history.

(56) References Cited

U.S. PATENT DOCUMENTS 3,100,309 A * 8/1963 Gambino ..... A46B 9/04 15/167.1
4,493,125 A * 1/1985 Collis ..... A46B 5/02 15/110
5,027,463 A * 7/1991 Daub ..... A46B 9/045 15/167.1
5,148,567 A * 9/1992 Daub ..... A46B 7/04 15/167.2
5,873,140 A * 2/1999 Holloway ..... A46B 9/045 15/167.1
9,066,580 B2 * 6/2015 Marichi Rodriguez ..... A46B 9/045
9,648,942 B2 * 5/2017 Nadeau ..... A46B 9/045

* cited by examiner

*Primary Examiner* — Sarah B McPartlin

(57) ABSTRACT

The new design of a toothbrush is designed so that it's easier to used compared to a normal toothbrush. It is designed so that the two sides clean the teeth or gums in one go and the inside front can clean the back ends of the gums and also inside the two sides in the front of the toothbrush has lower length bristles to brush the top of teeth or gums, also it is designed to rotate or swivel by handle to brush or clean and gaps which separate the gums or teeth. There can also be five separate heads that can slot on and slot of easily and safely and for safety the two sides that have bristles that extend from the base of the toothbrush curve in at the top and are at different lengths or heights. These bristles bend but do not stay bent.

1 Claim, 3 Drawing Sheets

TOOTHBRUSH

DETAILED DESCRIPTION

Figure 1:
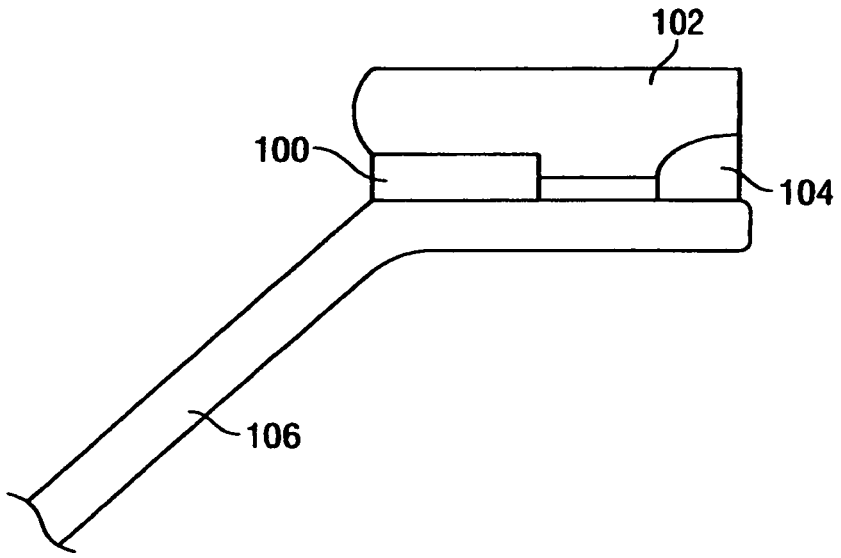
FIG. 1 illustrates a side view of the toothbrush.

FIG. 1 illustrates bristles 100 that clean the top of the teeth and gums, bristles 102 on both sides of toothbrush, bristles 104 that clean the ends of the gums that are in the middle of the two sides and handle 106 of the toothbrush.

Figure 2:
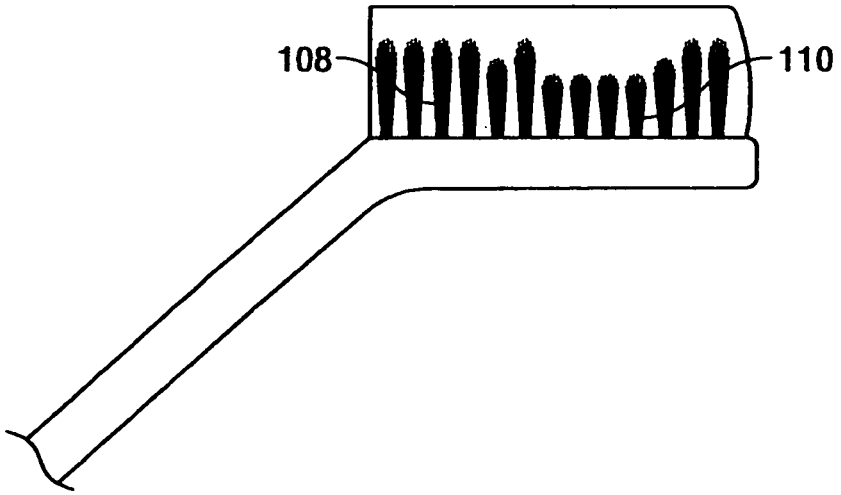
FIG. 2 illustrates a side view of the toothbrush.

FIG. 2 illustrates bristles longer 108 inside the two sides of the toothbrush for the cleaning the top of the teeth or gums, shorter bristles 110 in a round shape to clean the end of back gums.

Figure 3:
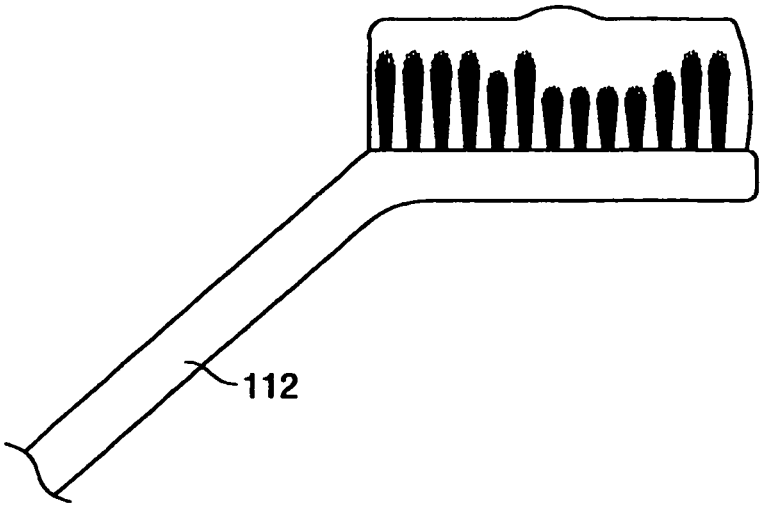
FIG. 3 illustrates a side view of the toothbrush.

FIG. 3 further illustrates handle 112 which is designed at the proper angle to use.

Figure 4:
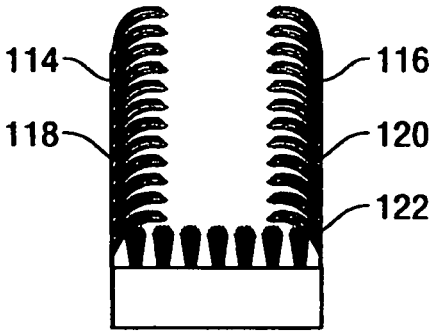
FIG. 4 illustrates an end view of the toothbrush.

FIG. 4 show that bristles 114 and 116 do bend but do not stay bent and that bristles 118 and 120 start from the bottom and extend up and curve in at different heights and lengths and bristles 122 clean both sides of the teeth and gums.

Figure 5:
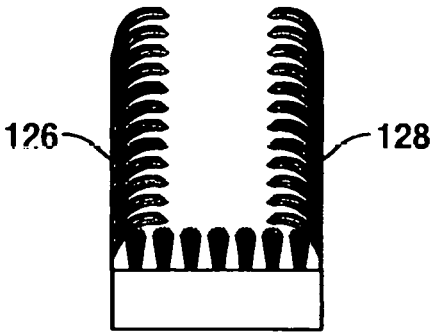
FIG. 5 illustrates an end view of the toothbrush.

FIG. 5 further illustrates bristles 126 and 128 that extend up from the base of the toothbrush and curve in at different heights.

Figure 6:
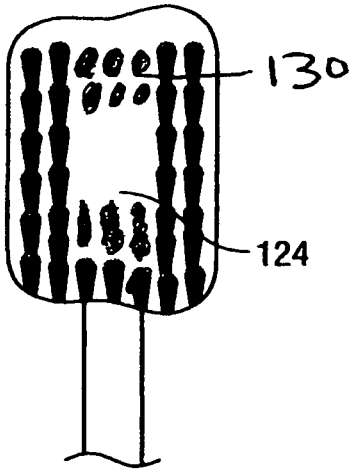
FIG. 6 illustrates a top view of the toothbrush.

FIG. 6 illustrates short bristles 124 in the middle of the two sides of bristles and bristles 130 inside the two sides of the extended bristles that clean the ends of the back gums.

What is claimed:

1. A tooth brush comprising:

a handle;

a base having a rear edge adjacent the handle, a front edge and a pair of opposing side edges;

a first set of bristles extending along substantially an entire length of one of said opposing side edges of the base, wherein the first set of bristles includes individual bristles of at least five different heights that extend upward from the base and curve inward toward a mid-line of the base at a top end thereof;

a second set of bristles adjacent the first set of bristles and adjacent the rear edge, wherein the second set of bristles are flat bristles adapted to clean tops of a user's teeth;

a third set of bristles adjacent said second set of bristles and extending along substantially an entire length of the other of said opposing side edges of the base, wherein the third set of bristles includes individual bristles of at least five different heights that extend upward from the base and curve inward toward the mid-line of the base at a top end thereof; and a fourth set of bristles adjacent the front edge, the first set of bristles and the third set of bristles, wherein the fourth set of bristles are flat bristles adapted to clean tops of the user's teeth and the fourth set of bristles is spaced from the second set of bristles along a length of said base forming a gap between the second set of bristles and the fourth set of bristles, wherein the gap has a length extending along said base substantially equal to a length of the base occupied by the fourth set of bristles.

* * * * *